US009316992B2

(12) United States Patent
Ishidate et al.

(10) Patent No.: US 9,316,992 B2
(45) Date of Patent: Apr. 19, 2016

(54) LIGHT SCANNING APPARATUS AND IMAGE FORMING APPARATUS

(71) Applicant: CANON KABUSHIKI KAISHA, Tokyo (JP)

(72) Inventors: Takehiro Ishidate, Tokyo (JP); Yasuaki Otoguro, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/602,912

(22) Filed: Jan. 22, 2015

(65) Prior Publication Data

US 2015/0212477 A1 Jul. 30, 2015

(30) Foreign Application Priority Data

Jan. 30, 2014 (JP) ..... 2014-015566
Dec. 25, 2014 (JP) ..... 2014-262546

(51) Int. Cl.

| | |
|---|---|
| ***G03G 15/00*** | (2006.01) |
| ***G03G 15/043*** | (2006.01) |
| ***G03G 21/16*** | (2006.01) |
| ***G03G 15/04*** | (2006.01) |

(52) U.S. Cl.

CPC ..... *G03G 15/80* (2013.01); *G03G 15/04036* (2013.01); *G03G 21/1652* (2013.01); *G03G 21/1666* (2013.01)

(58) Field of Classification Search

CPC ..... B41J 2/09; G03G 15/0436; G03G 15/20; G03G 21/1666; G03G 21/1652; G03G 15/80
See application file for complete search history.

(56) References Cited

U.S. PATENT DOCUMENTS

| | | | | |
|---|---|---|---|---|
| 7,522,326 | B1 | 4/2009 | Otoguro | 359/216 |
| 7,684,099 | B2 | 3/2010 | Otoguro | 359/216.1 |
| 8,564,868 | B2 | 10/2013 | Kusuda et al. | 359/196.1 |
| 8,947,478 | B2 | 2/2015 | Ishidate et al. | 347/137 |
| 2015/0002594 | A1 | 1/2015 | Ishidate et al. | 347/118 |
| 2015/0029284 | A1 | 1/2015 | Otoguro et al. | 347/134 |

FOREIGN PATENT DOCUMENTS

| | | | |
|---|---|---|---|
| JP | 01105273 A | * | 4/1989 |
| JP | H01-105273 | | 4/1989 |

(Continued)

OTHER PUBLICATIONS

U.S. Appl. No. 14/589,762, filed Jan. 5, 2015; Inventors: Daisuke Aruga, Yasuaki Otoguro.

*Primary Examiner* — Sarah Al Hashimi
(74) *Attorney, Agent, or Firm* — Fitzpatrick, Cella, Harper & Scinto

(57) ABSTRACT

A light scanning apparatus including: an optical box configured to hold a light source and contain a deflecting device configured to deflect a light beam to scan the photosensitive member; and an electric wire bundle electrically connected to the deflecting device, the electric wire bundle being laid in a space between an outer wall and an inner wall of the box, wherein the electric wire bundle extends over the inner wall from the inside of the inner wall, is laid in the space, and extends over the outer wall from the space to the outside of the box, and a portion at which the bundle extends over the outer wall is provided closer to an opening portion of an image forming apparatus than a portion at which the bundle extends over the inner wall when the light scanning apparatus is mounted to a mounting portion of the image forming apparatus.

14 Claims, 8 Drawing Sheets

(56) References Cited

FOREIGN PATENT DOCUMENTS

| | | | |
|---|---|---|---|
| JP | H6-43617 (u) | | 6/1994 |
| JP | H9-26553 | | 1/1997 |
| JP | 2001-105656 | | 4/2001 |
| JP | 2004125920 | A * | 4/2004 |
| JP | 4171634 | B2 | 10/2008 |
| JP | 2011-197614 | | 10/2011 |
| JP | 2011197614 | A * | 10/2011 |

* cited by examiner

LIGHT SCANNING APPARATUS AND IMAGE FORMING APPARATUS

BACKGROUND OF THE INVENTION

1. Field of the Invention

The present invention relates to a light scanning apparatus, and an image forming apparatus including the light scanning apparatus.

2. Description of the Related Art

Hitherto, an electrophotographic image forming apparatus (hereinafter referred to as an image forming apparatus) includes a light scanning apparatus configured to emit a laser beam (hereinafter referred to as a light beam). The light scanning apparatus emits the light beam, which, is modulated in accordance with image information, and scans a uniformly charged surface of a photosensitive member (surface to be scanned) with the light beam, to thereby form an electrostatic latent image on the surface to be scanned. The electrostatic latent image is developed into a toner image by a developing device with developer (toner). The toner image is transferred and fixed onto a recording medium. In this manner, an image is formed on the recording medium.

The light scanning apparatus includes a semiconductor laser (light source), a rotary polygon mirror (deflecting member) configured to deflect the light beam emitted from the semiconductor laser, a motor (deflection scanning device) configured to rotate the rotary polygon mirror, and an imaging optical system configured to image the light beam onto the surface to be scanned. The imaging optical system includes optical elements such as an fθ lens and a reflecting mirror. The semiconductor laser, the rotary polygon mirror, the motor, and the imaging optical system are arranged in an optical box (housing) with high accuracy.

A power supply electric wire and a signal wire (communication wire) are electrically connected to an electric circuit board configured to drive the motor. The power supply electric wire and the signal wire (communication wire) are bundled into an electric wire bundle. The electric wire bundle is led out of the optical box. The electric wire bundle led out of the optical box is connected to an electric wire bundle of a main body of the image forming apparatus through intermediation of a connector.

However, foreign matters adhering onto the electric wire bundle may soil the optical elements inside the optical box. The electric wire bundle is formed of a plurality of electric wires bundled with a band so as not to come apart from each other. The operation of binding the plurality of electric wires is carried out manually, and thus the foreign matters such as sebum and fuzz generated from a person or clothes adhere onto a surface of the electric wire bundle. The plurality of electric wires are densely bundled into the electric wire bundle, and hence it is difficult to fully remove the foreign matters from the electric wire bundle as a matter of fact. Specifically, the electric wire bundle having even a small amount of the foreign matters adhering thereonto is arranged inside the optical box, and thus the foreign matters may adhere onto the optical elements in the vicinity of the electric wire bundle. When the foreign matters adhere onto the optical elements, the light beam is shaded (vignetted), resulting in optical scanning failure, and further, image failure.

Further, depending on a route of the electric wire bundle to be laid inside the optical box, it is sufficiently conceivable that the electric wire bundle blocks an optical path of the light beam.

In view of the above, in Japanese Patent No. 4171634, various electric wire bundles are caused to pass through double walls formed on both sides of the optical box of the light scanning apparatus. The various electric wire bundles need not be laid over a long distance in a space in which optical components of the light scanning apparatus are mounted. Therefore, the risk of soiling the optical components or shading the light beam is suppressed, which leads to an advantage in obtaining stable quality of the image formation. In this manner, it is desired that the route of the electric wire bundle to be laid inside the optical box be short to the extent possible and be arranged in a different space partitioned from the space in which the optical components are mounted.

In recent years, however, from the viewpoint of enhancing maintainability of the image forming apparatus, the light scanning apparatus is removably mounted to the main body of the image forming apparatus. Therefore, at the time of mounting the light scanning apparatus to the main body of the image forming apparatus, there is a problem in that the electric wire bundle led out of the light scanning apparatus is caught in the components of the main body, thereby obstructing the mounting.

SUMMARY OF THE INVENTION

In view of the above, the present invention provides a light scanning apparatus and an image forming apparatus, which are capable of facilitating electrical connection between a main body of the image forming apparatus and the light scanning apparatus at the time of mounting the light scanning apparatus to the main body of the image forming apparatus.

In order to solve the above-mentioned problem, according to one embodiment of the present invention, there is provided a light scanning apparatus to be mounted to a mounting portion of an image forming apparatus through an opening portion of the image forming apparatus including a photosensitive member, the light scanning apparatus comprising:

a light source configured to emit a light beam;

a deflecting device configured to deflect the light beam emitted from the light source so as to scan the photosensitive member with the light beam;

an optical box including an outer wall and an inner wall extending inside the outer wall and along the outer wall so as to face the outer wall, and configured to hold the light source and contain the deflecting device inside the inner wall; and an electric wire bundle electrically connected to the deflecting device, wherein the optical box includes a space in which the electric wire bundle is laid being formed between the outer wall and the inner wall, wherein the electric wire bundle extends over the inner wall from a space on an inner side of the inner wall so as to be laid in the space formed between the outer wall and the inner wall, and extends over the outer wall from the space formed between the outer wall and the inner wall so as to lead to a space on an outer side of the optical box, and wherein the electric wire bundle is laid in the optical, box so that, in a state in which the light scanning apparatus is mounted to the mounting portion of the image forming apparatus, a portion at which the electric wire bundle extends over the outer wall is provided closer to the opening portion of the image forming apparatus than a portion at which the electric wire bundle extends over the inner wall.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[First Embodiment]

(Image Forming Apparatus)

Figure 2:
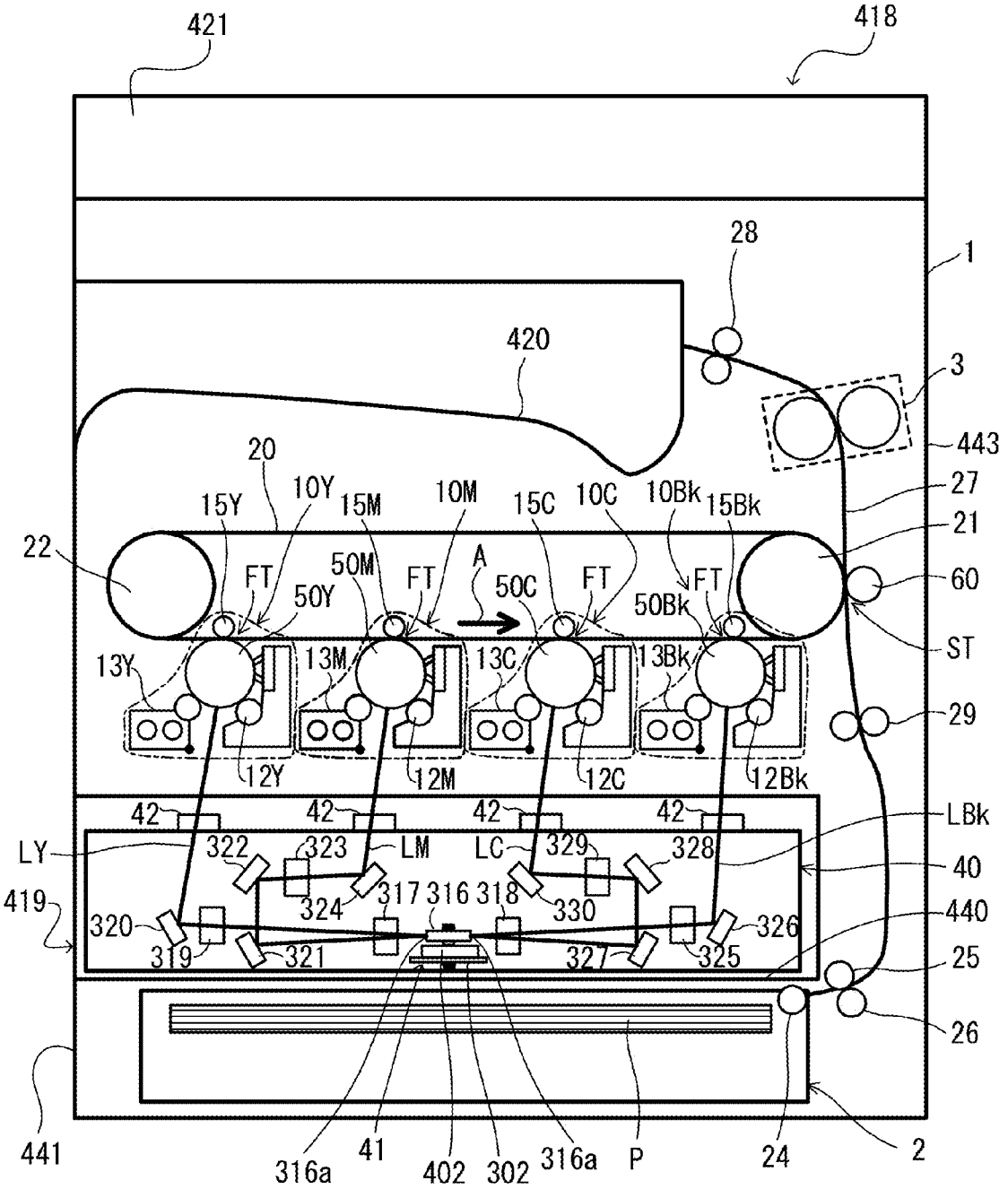
FIG. 2 is a sectional view illustrating an image forming apparatus according to the first embodiment.

An electrophotographic image forming apparatus (hereinafter referred to as an image forming apparatus) 418 including a light scanning apparatus 40 according to a first embodiment will be described. FIG. 2 is a sectional view illustrating the image forming apparatus 418 according to the first embodiment. As an example of the image forming apparatus 418, a tandem-type color laser beam printer is illustrated.

The image forming apparatus 418 is configured to form an image on a recording medium (hereinafter referred to as a sheet) P by an electrophotographic method. The image forming apparatus 418 includes four image forming portions 10 (10Y, 10M, 10C, 10Bk).

The image forming portions 10 each include a photosensitive member (photosensitive drum) 50 (50Y, 50M, 50C, 50Bk). A charging roller (charging device) 12 (12Y, 12M, 12C, 12Bk), a developing device 13 (13Y, 13M, 13C, 13Bk), and a primary transfer roller (primary transfer member) 15 (15Y, 15M, 15C, 15Bk) are arranged around each of the photosensitive member 50.

A single light scanning apparatus (exposure apparatus) 40 is arranged below the four image forming portions 10. In the embodiment, light beams are emitted from the single light scanning apparatus 40 to the four photosensitive members 50, respectively. However, the embodiment is not limited thereto. The light scanning apparatus may be provided to each of the four image forming portions 10 so as to emit a single light beam from each of the light scanning apparatus to a corresponding single photosensitive member.

The developing device 13 contains two-component developer including toner and carrier.

The image forming apparatus 418 includes an intermediate transfer belt (intermediate transfer member) 20 onto which toner images of a plurality of colors are primarily transferred from the respective image forming portions 10. The intermediate transfer belt 20 is arranged above the four image forming portions 10. The intermediate transfer belt 20 is an endless belt which is passed over a pair of belt conveyance rollers 21 and 22. The intermediate transfer belt 20 is rotated in a rotational direction indicated by the arrow A.

The primary transfer roller 15 is arranged so as to face the photosensitive member 50 of the image forming portion 10 across the intermediate transfer belt 20. The primary transfer roller 15 forms a primary transfer portion FT between intermediate transfer belt 20 and the photosensitive member 50. A transfer voltage is applied to the primary transfer roller 15 so that a transfer electric field is formed in the primary transfer portion FT. In the transfer electric field of the primary transfer portion FT, the electrically charged toner image on the photosensitive member 50 is primarily transferred onto the intermediate transfer belt 20 by a Coulomb force.

The four image forming portions 10Y, 10M, 10C, and 10Bk are arranged in line below the intermediate transfer be 20. Along the rotational direction A of the intermediate transfer belt 20, the yellow image forming portion 10Y, the magenta image forming portion 10M, the cyan image forming portion 10C, and the black image forming portion 10Bk are arranged in the stated order. The image forming portions 10 form a yellow toner image, a magenta toner image, a cyan toner image, and a black toner image with the toners of the respective colors.

A secondary transfer roller 60 is arranged so as to face the belt conveyance roller 21 across the intermediate transfer belt 20. The belt conveyance roller 21 and the secondary transfer roller 60 form a secondary transfer portion ST between the intermediate transfer belt 20 and the secondary transfer roller 60.

A sheet feeding cassette 2 configured to contain the sheets P is provided in a lower portion of a main body 1 of the image forming apparatus 418. The sheet feeding cassette 2 is removably mounted to the lower portion of the main body 1 from a side surface 441 of the main body 1. A pickup roller 24 and a feed roller 25 are provided above the sheet feeding cassette 2. The pickup roller 24 and the feed roller 25 are configured to feed the sheets P contained in the sheet feeding cassette 2 one by one. A retard roller 26 is arranged so as to face the feed roller 25 in order to prevent multi-feeding of the sheets P.

A conveyance path 27 of the sheet P in an interior of the main body 1 is formed so as to be substantially vertical along a right side surface 443 of the main body 1. A registration roller pair 29, the secondary transfer portion ST, a fixing device 3, and a delivery roller pair 28 are provided in the conveyance path 27.

(Image Forming Process)

Now, an image forming process in the image forming apparatus 418 will be described.

The charging roller 12 uniformly charges a surface of the photosensitive member 50. The light scanning apparatus 40 exposes the uniformly charged surface of the photosensitive member 50 to a laser beam (hereinafter referred to as a light beam) L (LY, LM, LC, LBk), which is modulated in accordance with image information of each color, to form an electrostatic latent image on the surface of the photosensitive member 50. The developing device 13 develops the electrostatic latent image with the toner of each color, to thereby form the toner image of each color on the photosensitive member 50.

The toner images of the four colors formed by the four image forming portions 10 are primarily transferred by the primary transfer rollers 15 onto the intermediate transfer belt 20 rotated in the rotational direction A, and are then superimposed on the intermediate transfer belt 20.

On the other hand, the sheet P is fed to the registration roller pair 29 from the sheet feeding cassette 2 by the pickup roller 24 and the feed roller 25. The registration roller pair 29 conveys the sheet P to the secondary transfer portion ST between the secondary transfer roller 60 and the intermediate transfer belt 20 in synchronization with the toner images superimposed on the intermediate transfer belt 20. The toner images superimposed on the intermediate transfer belt 20 are secondarily transferred onto the sheet P collectively in the secondary transfer portion ST.

The sheet P on which the toner images have been transferred is conveyed upward along the conveyance path 27. The sheet P is conveyed to the fixing device 3 provided above the secondary transfer portion ST. The fixing device 3 heats and pressurizes the sheet P, to thereby fix the toner images onto the sheet P. In this manner, a full-color image is formed on the sheet P. The sheet P on which the full-color image is formed is delivered onto a delivery tray 420 provided. in an upper portion of the main body 1 by the delivery roller pair 28.

(Light Scanning Apparatus)

As described above, in a case of forming the full-color image by the image forming apparatus 418, the light scanning apparatus 40 is configured to expose the photosensitive members 50Y, 50M, 50C, and 50Bk of the respective image forming portions 10 to the light beams at respective predetermined timings in accordance with the image information of the respective colors. With this, the toner images of the respective colors are formed on the photosensitive members 50 in accordance with the image information of the respective colors. in order to obtain the full-color image with high quality, positions of the electrostatic latent images formed by the light scanning apparatus 40 need to be reproducibly aligned with high accuracy. Now, the light scanning apparatus 40 will be described.

As illustrated in FIG. 2, the light scanning apparatus 40 is arranged below the plurality of image forming portions 10. A mounting portion 440 is formed between the plurality of image forming portions 10 and the sheet feeding cassette 2 in the main body 1 of the image forming apparatus 418. The light scanning apparatus 40 is mounted to the mounting portion 440. The light scanning apparatus 40 is configured to expose the surface of the photosensitive member 50 provided to each of the plurality of image forming portions 10 to the light, beam L (LY, LM, LC, LBk), which is modulated in accordance with the image information of each color.

Figure 1:
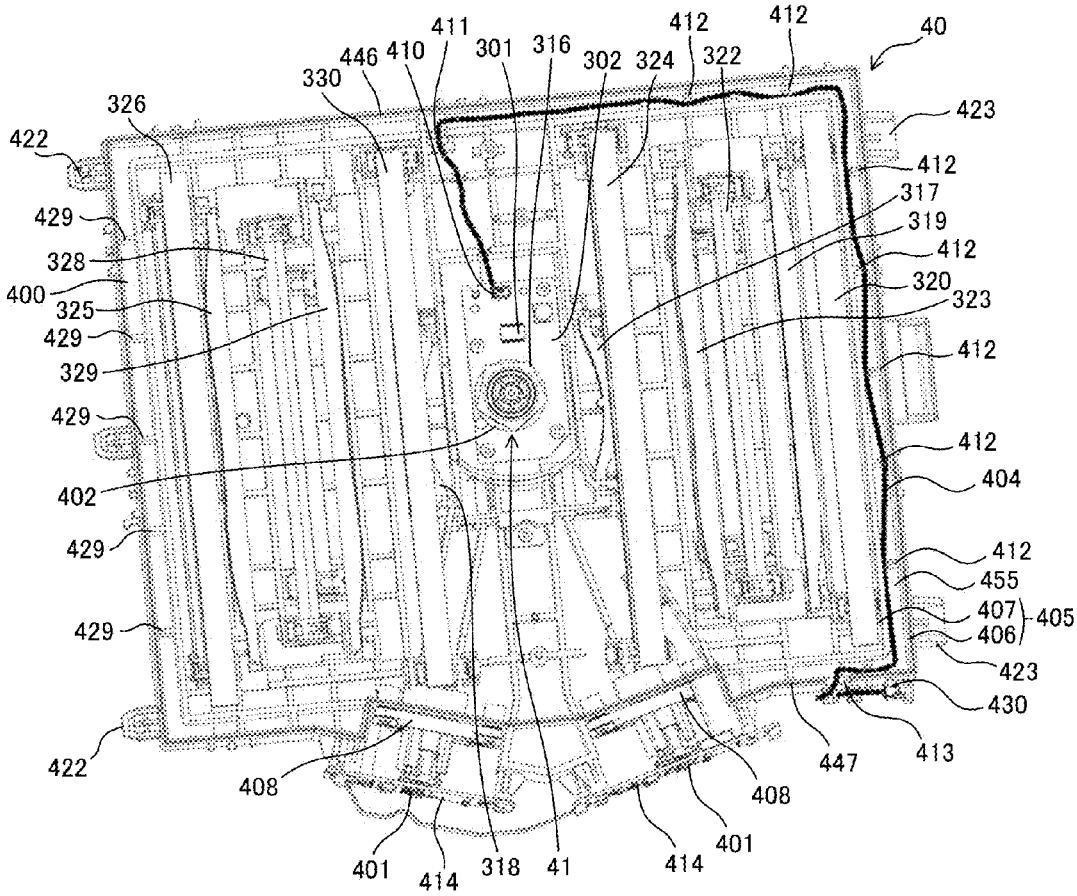
FIG. 1 is a perspective view illustrating a light scanning apparatus according to a first embodiment.

FIG. 1 is a perspective view illustrating the light scanning apparatus 40 according to first embodiment. In FIG. 1, for the sake of illustration of an internal structure of an optical box (housing) 400 of the light scanning apparatus 40, a cover member 415 (FIG. 3) is removed from the optical box 400.

The light scanning apparatus 40 includes a plurality of semiconductor lasers (hereinafter referred to as light sources) 401, a deflecting device 41, an incident optical system, an imaging optical system (imaging optical member), the optical box 400, and an electric wire bundle (wire harness) 404. The electric wire bundle 404 is connected to the deflecting device 41. The electric wire bundle 404 includes a power supply electric wire configured to supply power to the deflecting device 41, and a signal wire (communication wire) configured to transmit a signal to the deflecting device 41. The optical box 400 contains the deflecting device 41, the incident optical system, and the imaging optical system (optical elements 317 to 330). The optical box 400 has a substantially rectangular parallelepiped shape.

A laser drive circuit board 414 is configured to drive the light source 401. The light source 401 is configured to emit the light beam, which is modulated in accordance with the image information input to the laser drive circuit board 414. Two light source units 408 hold the two light sources 401 and the laser drive circuit boards 414. The light source units 408 are fixed to a side 447 of the optical box 400. The four light beams L (LY, LM, LC, LBk) emitted from the four light sources 401 enter the single deflecting device 41.

The deflecting device 41 includes a rotary polygon mirror (deflecting member) 316 having a plurality of reflecting surfaces (deflecting surfaces) 316*a*, a motor 402 configured to rotate the rotary polygon mirror 316, a drive circuit 301 configured to drive the motor 402, and an electric circuit board 302 configured to hold the motor 402 and the drive circuit 301. The deflecting device 41 is mounted to the optical box 400.

In FIG. 2, the two light beams LY and LM enter one side of the deflecting device 41 (left side of FIG. 2), and the two light beams LC and LBk enter another side of the deflecting device 41 (right side of FIG. 2). The light beams L deflected by the deflecting device 41 are each guided by the imaging optical system (optical elements 317 to 330) arranged inside the light scanning apparatus 40, to thereby travel through respective optical paths. Then, the light beams L expose the respective photosensitive members 50Y, 50M, 50C, and 50Bk of the image forming portions 10 through respective irradiation window glasses 42 arranged at an upper portion of the light scanning apparatus 40.

The imaging optical system (optical elements 317 to 330) include optical lenses (fθ lenses) through which the light beams L deflected by the deflecting device 41 at a constant angular speed scan the respective surfaces (surfaces to be scanned) of the photosensitive members 50 at a constant speed. The optical lenses (fθ lenses) include first optical lenses (spherical lenses) 317 and 318 and second optical lenses (toric lenses) 319, 323, 325, and 329.

Mirrors 320, 321, 322, 324, 326, 327, 328, and 330 are arranged in the optical paths so as to guide the deflected light beams L onto the respective photosensitive members 50.

The optical elements 317 to 330 of the imaging optical system are positioned and fixed by attaching portions (positioning mechanisms) of the optical box 400, respectively.

(Optical Box)

In the optical box 400, a double wall 405 including an outer wall 406 and an inner wall 407 is formed. The inner wall 407 has a height substantially equal to that of the outer wall 406 so as to face the outer wall 406. However, the height of the inner wall 407 is not limited thereto. The height of the inner wall 407 may be slightly smaller than the height of the outer wall 406. The outer wall 406 partitions an exterior and an interior of the optical box 400. The inner wall 407 extends along the outer wall 406 so as to partition the interior of the optical box 400 defined by the outer wall 406. The inner wall 407 and the outer wall 406 form a space (route) 455, in which the electric wire bundle 404 is to be laid, between the inner wall 407 and the outer wall 406. The electric wire bundle 404 is laid in the space 455 of the double wall 405 along the outer wall 406.

The double wall 405 is formed on a periphery of the optical box 400 except for a region in which the light source units 408 are mounted. The double wall may be formed also in the region in which the light source units 408 are mounted. An inlet 411 and an outlet 413 are formed in the double wall 405. The outlet 413 is a cutout formed in the outer wall 406. By mounting the cover member 415 described later to the optical box 400, an opening (second opening) is formed between the cover member 415 and the outer wall 406. Specifically, by mounting the cover member 415 to the optical box 400, one end of the cutout of the outer wall 406 is closed by the cover member 415 so that the opening is formed. The electric wire bundle 404 is laid in the cutout of the outer wall 406 before the cover member 415 is mounted to the optical box 400. In this state, the cover member 415 is mounted to the optical box 400. With this, the electric wire bundle 404 is brought into a state of being inserted from the outside of the optical box 400 into the double wall 405. On the other hand, the inlet 411 is a cutout formed in the inner wall 407. By mounting the cover member 415 described later to the optical box 400, an opening (first opening) is formed between the cover member 415 and the inner wall 407. Specifically, by mounting the cover member 415 to the optical box 400, one end of the cutout of the inner wall 407 is closed by the cover member 415 so that the opening is formed. The electric wire bundle 404 is laid in the cutout of the inner wall 407 before the cover member 415 is mounted to the optical box 400. In this state, the cover member 415 is mounted to the optical box 400. With this, the electric wire bundle 404 is brought into a state of being inserted from the double wall 405 into the interior space of the optical box 400. The inlet 411 is formed in the inner wall 407 of the double wall 405 on a side 446 opposite to the side 447 on which the light source units 408 are provided. The outlet 413 is formed in the outer wall 406 of the double wall 405 on the side 447 on which the light source units 408 are provided.

The electric wire bundle 404 is connected to a connector 410 provided to the electric circuit board 302 of the motor 402. A position of the inlet 411 is set so that the electric wire bundle 404 entering the inlet 411 is distanced from the optical path of the light beam. Specifically, the inlet 411 is formed in the inner wall on an opposite side across the deflecting device 41 to the side on which the light source units 408 are provided. The electric wire bundle 404 passes through the inlet 411 from the connector 410 so as to extend (lead) to the inside (space) of the double wall 405. The electric wire bundle 404 extends inside the space 455 from the inlet 411 to the outlet 413 along the outer wall 406. The electric wire bundle 404 extends over the inner wall 407 from a space on an inner side of the inner wall 407 so as to be laid in the space 455 formed between the outer wall 406 and the inner wall 407, and extends over the outer wall 406 from the space 455 formed between the outer wall 406 and the inner wall 407 so as to lead to a space on an outer side of the optical box 400.

The reason why the electric wire bundle 404 is not directly guided from the electric circuit board 302 to the side 447 on which the light source units 408 are provided is to prevent the electric wire bundle 404 from blocking the optical path of the incident optical system provided between the electric circuit board 302 and the light source units 408 and the optical path of a scanning optical system ranging from the deflecting device 41 to the photosensitive drums. The electric wire bundle 404 extends around the imaging optical system.

The electric wire bundle 404 is arranged inside the double wall 405 so as to extend from the inlet 411 to the outlet 413 along the periphery of the optical box 400. The electric wire bundle 404 is regulated by a plurality of regulating ribs 412 which protrude from the outer wall 406 or the inner wall 407 toward the inside of the double wall 405 so as to prevent the electric wire bundle 404 from being moved in a vertical direction due to the stiffness of the electric wire bundle 404. The electric wire bundle 404 passes through the outlet 413 formed on an opposite side to the inlet 411, thereby exiting to the outside of the optical box 400. In the first embodiment, the electric wire bundle 404 is connected to a motor electric wire bundle connector 430 (hereinafter referred to as a connector), which is held by the optical box 400. The connector 430 is fixed to the optical box 400 at an end portion on the side on which the light source units 408 are provided.

Figure 3:
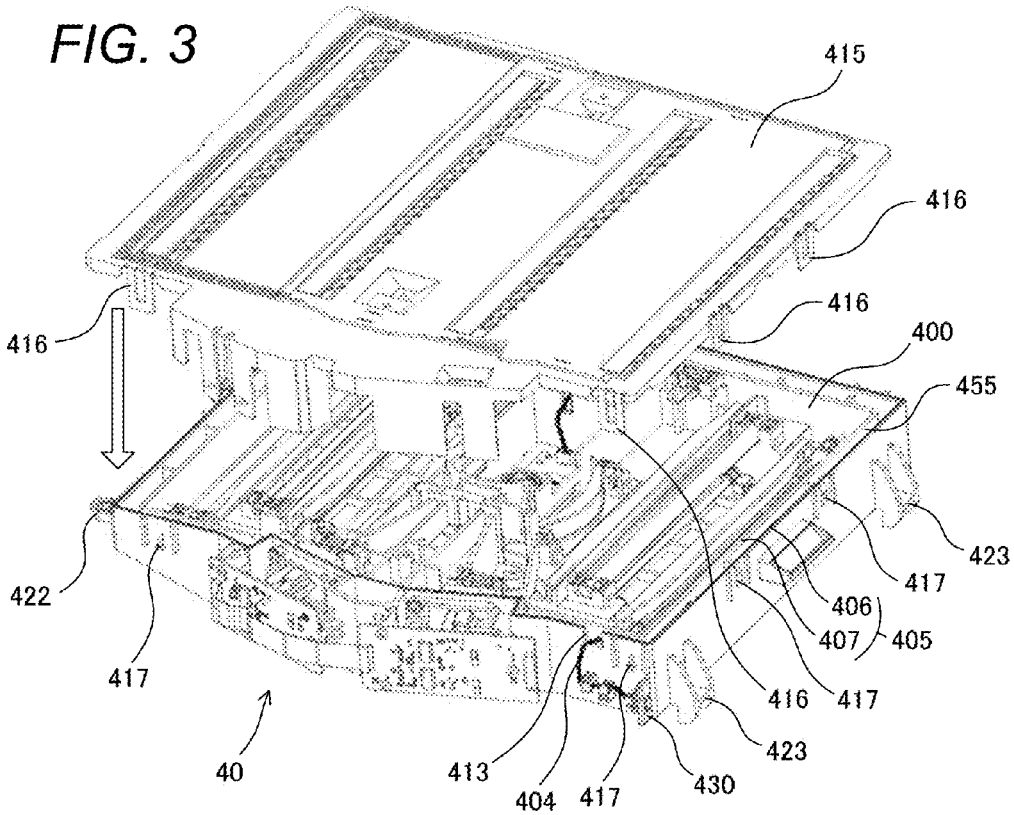
FIG. 3 is a perspective view illustrating an optical box and a cover member according to the first embodiment.

FIG. 3 is a perspective view illustrating the optical box 400 and the cover member 415 according to the first embodiment. The cover member 415 and the optical box 400 are fastened by a snap-fit configuration including a plurality of claw portions 416 provided on the cover member 415, and protruding portions 417 provided on the optical box 400 correspondingly to the plurality of claw portions 416.

Figure 4:
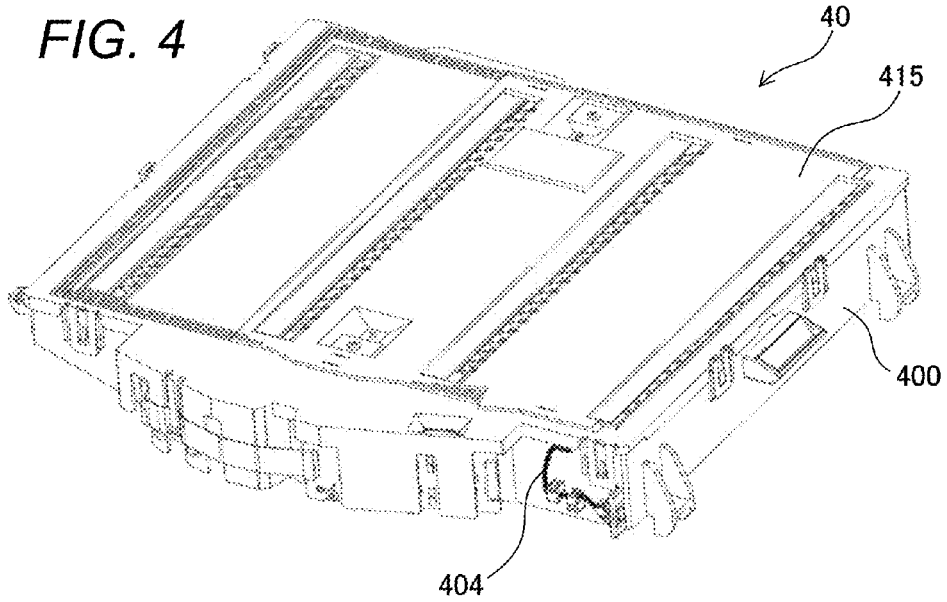
FIG. 4 is a perspective view illustrating the light scanning apparatus in which the cover member is mounted to the optical box according to the first embodiment.

FIG. 4 is a perspective view illustrating the light scanning apparatus 40 in which the cover member 415 is mounted to the optical box 400 according to the first embodiment. When the cover member 415 is mounted to the optical box 400, the electric wire bundle 404 is covered by the cover member 415 from above, thereby being contained inside the double wall 405 without protruding to the outside of the optical box 400.

(Mounting of Light Scanning Apparatus to Image Forming Apparatus)

Next, a method of mounting the light scanning apparatus 40 to the image forming apparatus 418 and a method of connecting the electric wire bundle 404 of the light scanning apparatus 40 to the image forming apparatus 418 will be described.

Figure 5:
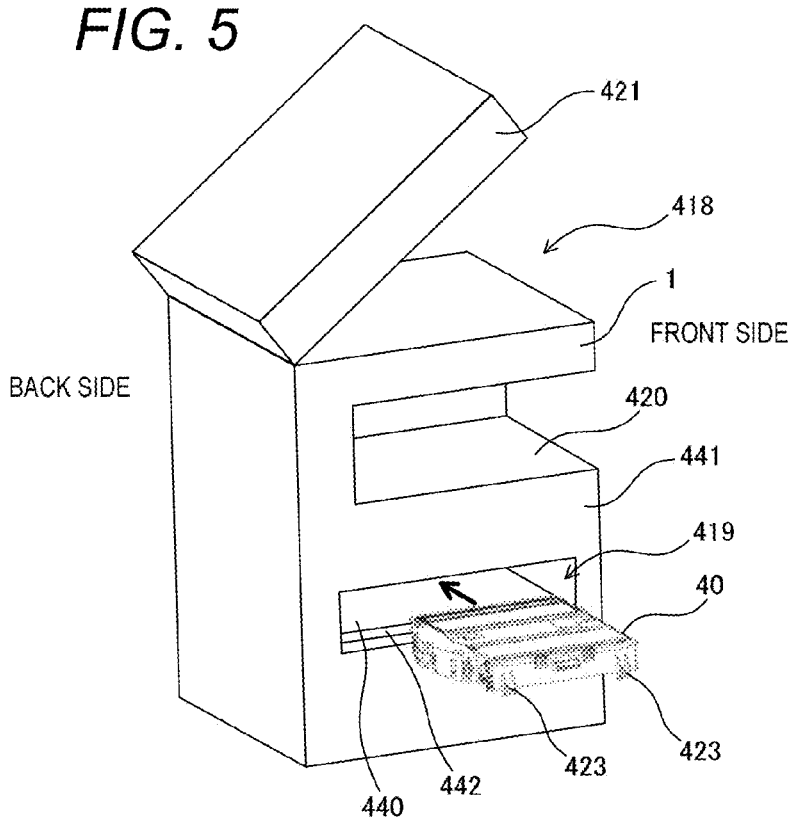
FIG. 5 is a schematic view illustrating the image forming apparatus according to the first embodiment.

FIG. 5 is a schematic view illustrating the image forming apparatus 418 according to the first embodiment. A pressure plate portion 421 is arranged at an upper portion of the image forming apparatus 418. The delivery tray 420 is provided in a middle portion of the front side (right side of FIG. 5) of the image forming apparatus 418. An opening portion 419 is provided in the side surface 441 of the image forming apparatus 418. The light scanning apparatus 40 is removably mounted to the mounting portion 440 provided in the interior of the main body 1 of the image forming apparatus 418 through the opening portion 419. The opening portion 419 is closed by a lid member (not shown).

Figure 6:
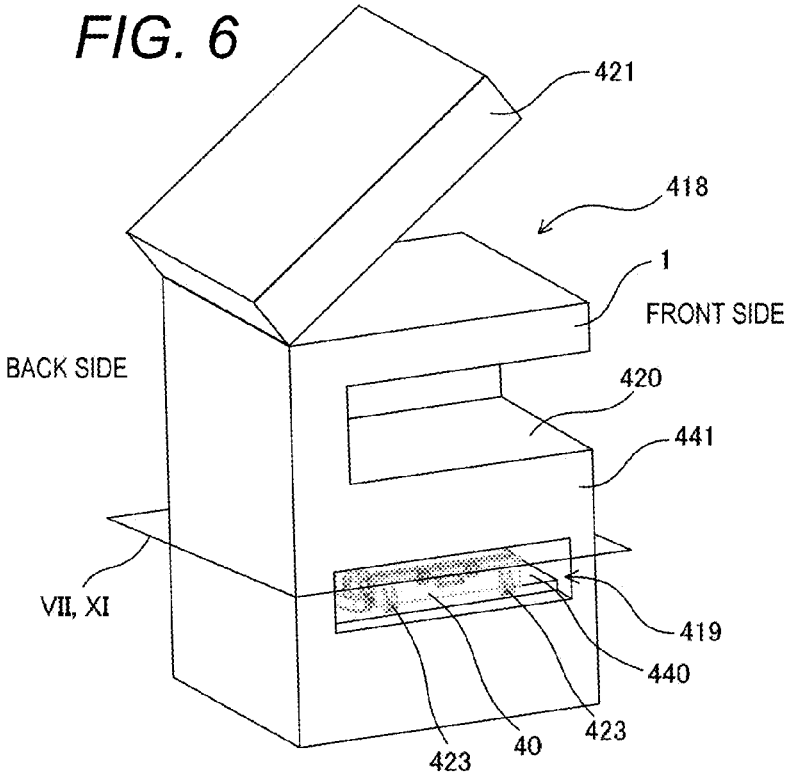
FIG. 6 is a perspective view illustrating the image forming apparatus in which the light scanning apparatus according to the first embodiment is positioned.
Figure 7:
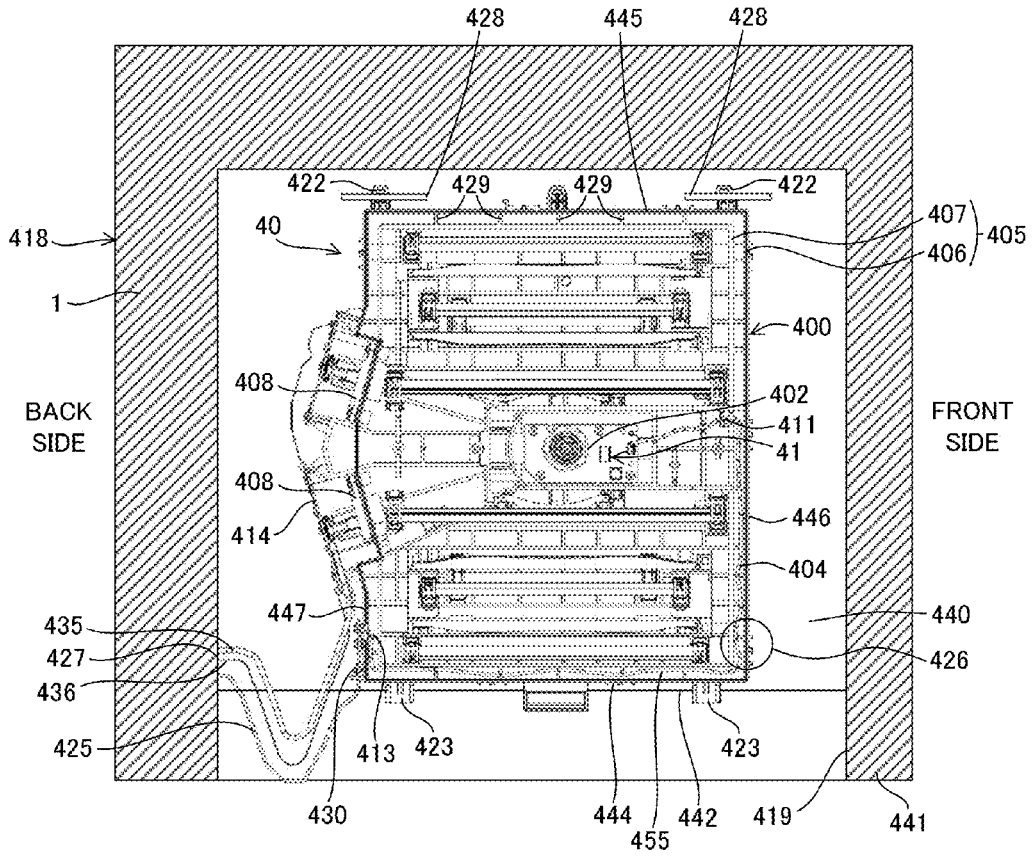
FIG. 7 is a sectional view illustrating the image forming apparatus according to the first embodiment, which is taken along the plane VII of FIG. 6.

FIG. 6 is a perspective view illustrating the image forming apparatus 418 in which the light scanning apparatus 40 according to the first embodiment is positioned. FIG. 7 is a sectional view illustrating the image forming apparatus 418 according to the first embodiment, which is taken along the plane VII of FIG. 6. Note that, for the sake of illustration, the cover member 415 is removed from the light scanning apparatus 40 in FIG. 7.

As illustrated in FIG. 7, each pressure seating surface portion (fixing portion) 422 of the light scanning apparatus 40 is pressed by a wire spring 428 (pressing member) provided in the image forming apparatus 418, thereby being fixed to the mounting portion 440. Each abutment portion (fixing portion) 423 of the light scanning apparatus 40 is brought into abutment against a positioning seating surface 442 provided on the mounting portion 440 of the image forming apparatus 418. With this the light scanning apparatus 40 is positioned with respect to the main body 1. The abutment portion 423 is fixed to the positioning seating surface 442 by a screw (not shown).

The main body 1 of the image forming apparatus 418 includes electric wire bundles 425, 435, and 436. The electric wire bundles 435 and 436 of the main body 1 are electrically connected to the laser drive circuit boards 414 of the light scanning apparatus 40. The electric wire bundle 435 includes a power supply electric wire configured to supply power to each of the light source units 408. The electric wire bundle 436 includes a communication wire configured to communicate with each of the light source units 408, a drive signal wire configured to transmit a drive signal for driving each of the light source units 408, and an image signal wire configured to transmit an image signal to each of the light source units 408.

The electric wire bundle 425 of the main body 1 is connected. to the connector 430 of the light scanning apparatus 40. The electric wire bundle 425 includes a power supply electric wire configured to supply power to the deflecting device 41, and a signal wire (communication wire) configured to transmit a signal to the deflecting device 41. When the electric wire bundle 425 of the main body 1 is connected to the connector 430, the electric wire bundle 404 is energized, and the drive and control of the motor 402 are enabled.

The route of the electric wire bundle 404 passing through the double wall 405 is herein focused again. The outlet 413 of the double wall 405 is arranged closer to the opening portion 419 than the inlet 411. The reason is as follows. At the time of mounting the light scanning apparatus 40 to the image forming apparatus 418, the electric wire bundle 425 of the main body 1 is connected to the electric wire bundle 404 of the light scanning apparatus 40. Specifically, when the connector 430 provided on the light scanning apparatus 40 is positioned on a far side (a side opposite to the opening portion 419) of the light scanning apparatus 40, the light scanning apparatus 40 needs to be pushed into the image forming apparatus 418 by a long distance while maintaining the connection between the electric wire bundle 425 of the main body 1 and the connector 430. In this case, at the time of inserting the light scanning apparatus 40 into the opening portion 419, the electric wire bundle 425 of the main body 1 may be caught in other components, screw members, and the like arranged in the mounting portion 440, with the result that mounting easiness is deteriorated. Therefore, it is preferred that the connector 430 be arranged close to the opening portion 419. Further, it is preferred that a distance between. the outlet 413 and the connector 430 be smaller in order to shorten the electric wire bundle 404 exposed to an exterior of the light scanning apparatus 40. As a result, it is preferred that the outlet 413 of the double wall 405 be arranged closer to the opening portion 419 than the inlet 411.

In the embodiment, the route of the electric wire bundle 404 illustrated in FIG. 7 is used. However, the route of the electric wire bundle 404 is not limited to the route illustrated in FIG. 7 as long as the outlet 413 of the double wall 405 arranged closer to the opening portion 419 than the inlet 411.

For example, the electric wire bundle 404 may be laid in the double wall 405 counterclockwise from the inlet 411 in FIG. 7. The electric wire bundle 404 may extend in the double wall 405 formed on a side 445, which is a side opposite to the opening portion 419, of the optical box 400. In the embodiment, the double wall 405 ends at the region in which the light source units 408 are mounted. However, in this case, the double wall may also be formed in the region in which the light source units 408 are mounted. When the outlet of the double wall 405 is arranged closer to the opening portion 419 than the inlet 411, similar effects to those of the embodiment can be obtained. However, in this case, the electric wire bundle 404 becomes longer than that in the embodiment of FIG. 7. Therefore, as illustrated in FIG. 7 of the embodiment, it is desired that the route of the electric wire bundle 404 extend along, among four sides of the optical box 400, at least a side 444 close to the side surface 441 in which the opening portion 419 is provided.

Further, the outlet 413 of the double wall 405 may be formed at an end portion 426, which is close to the opening portion 419, of the side 446 on the front side of the optical box 400. In a case in which the signal wire of the main body 1 configured to control the motor 402 is led out from the front side of the main body 1, it is preferred that the outlet 413 be formed at the end portion 426, which is close to the opening portion 419, of the side 446 on the front side. The reason is that the electric wire bundle 404 can be connected to the electric wire bundle of the main body 1 on the front side of the main body 1 of the image forming apparatus 418.

However, in general, large-scale electrical components that drive and control various components of the image forming apparatus 418 are often collectively provided on the back side of the main body 1. Therefore, as in the embodiment, the electric wire bundles 425, 435, and 436 of the main body 1 are often guided from the back side of the image forming apparatus 418. Accordingly, it is desired that the outlet 413 of the double wall 405 be arranged so as to face a guide portion (supply portion) 427 of the electric wire bundles 425, 435, and 436 of the main body 1 on the back side of the image forming apparatus 418.

In the embodiment, the abutment portion 423 provided on the side 444 of the light scanning apparatus 40 is fastened to the positioning seating surface 442 on the side of the opening portion 419 by a screw. The pressure seating surface portion 422 provided on the side 445 is pressed by the wire spring 428 on a side opposite to the opening portion 419. With this, the light scanning apparatus 40 is fixed to the mounting portion 440. The reason will be described below.

On the side 444 on which the electric wire bundle 404 is laid in the double wall 405, the outer wall 406 and the inner wall 407 cannot be connected to each other by reinforcement ribs 429 because the electric wire bundle 404 extends in the double wall 405. On the other hand, on the side 445 on which no electric wire bundle 404 is laid in the double wall 405, the outer wall 406 and the inner wall 407 can be connected to each other by the reinforcement ribs 429 so as to reinforce the outer wall 406 of the optical box 40. Specifically, the rigidity of the side 444 on which the electric wire bundle 404 is laid is lower than the rigidity of the side 445 on which no electric wire bundle 404 is laid. Therefore, when the light scanning apparatus 40 is fixed to the mounting portion 440 while locating the side 444 having lower rigidity on the side of the opening portion 419, the side 444 is fixed to the positioning seating surface 442 by the screw fixation which is stronger than the spring fixation. With this, the lower rigidity is compensated.

[Second Embodiment]

Next, a second embodiment will be described. In the second embodiment, the same components as those in the first embodiment are denoted by the same reference symbols, and description thereof is omitted. An image forming apparatus and a light scanning apparatus according to the second embodiment are the same as those in the first embodiment, and description thereof is therefore omitted.

(Optical Box)

The second embodiment differs from the first embodiment in that the electric wire bundle 404 extending from the outlet 413 of the double wall 405 to the exterior of the optical box 400 is directly connected to a motor electric wire bundle connector 431 (hereinafter simply referred to as a connector), which is provided on the laser drive circuit board 414.

Figure 8:
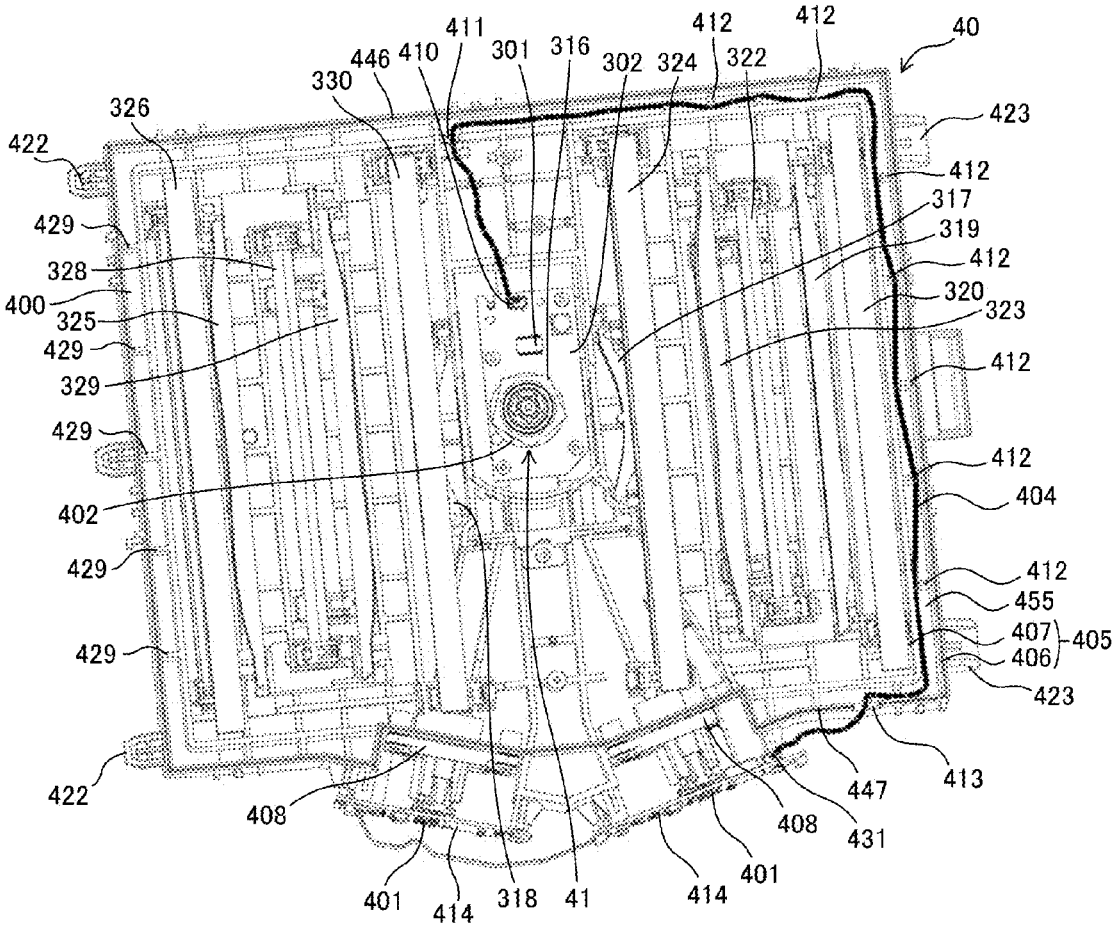
FIG. 8 is a perspective view illustrating a light scanning apparatus according to a second embodiment.

FIG. 8 is a perspective view illustrating the light scanning apparatus 40 according to the second embodiment. The electric wire bundle 404 exposed from the outlet 413 of the double wall 405 is electrically connected to the connector 431 provided on the laser drive circuit board 414. The outlet 413 is formed on the side 447 on which the light source units 408 are mounted. It is preferred that the outlet 413 be formed in the vicinity of the light source units 408.

Figure 9:
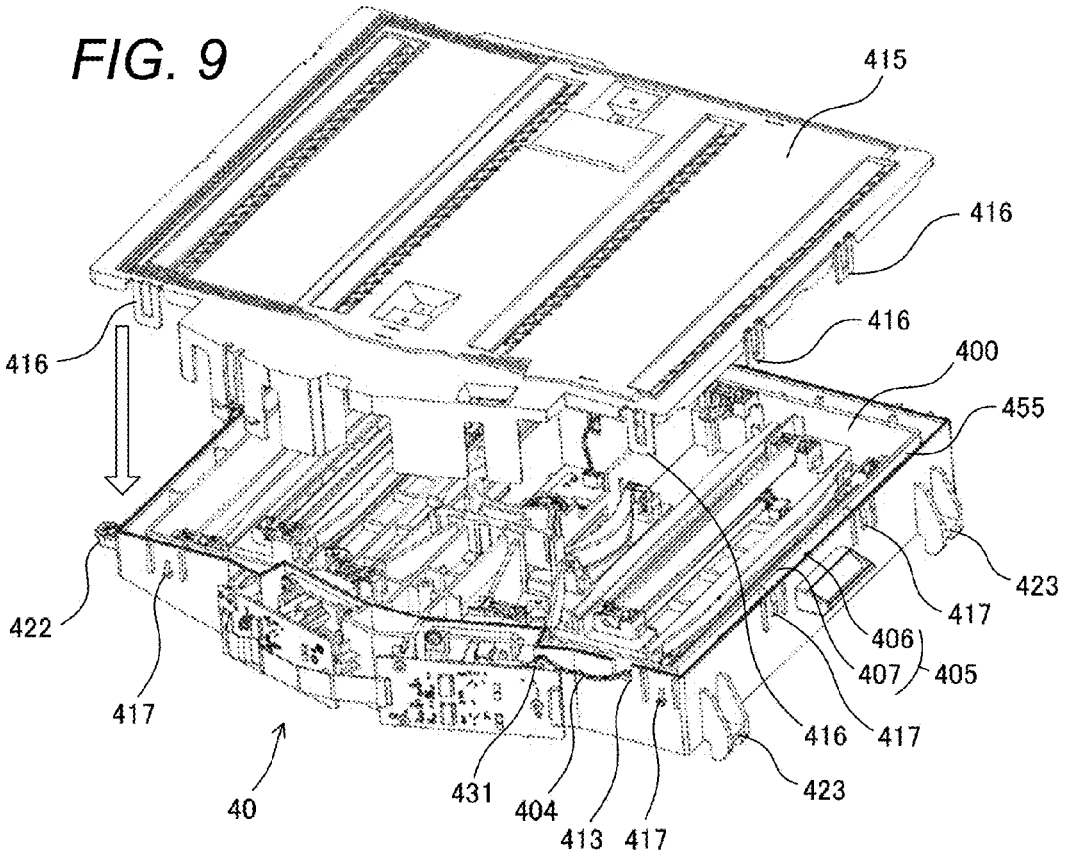
FIG. 9 is a perspective view illustrating an optical box and a cover member according to the second embodiment.
Figure 10:
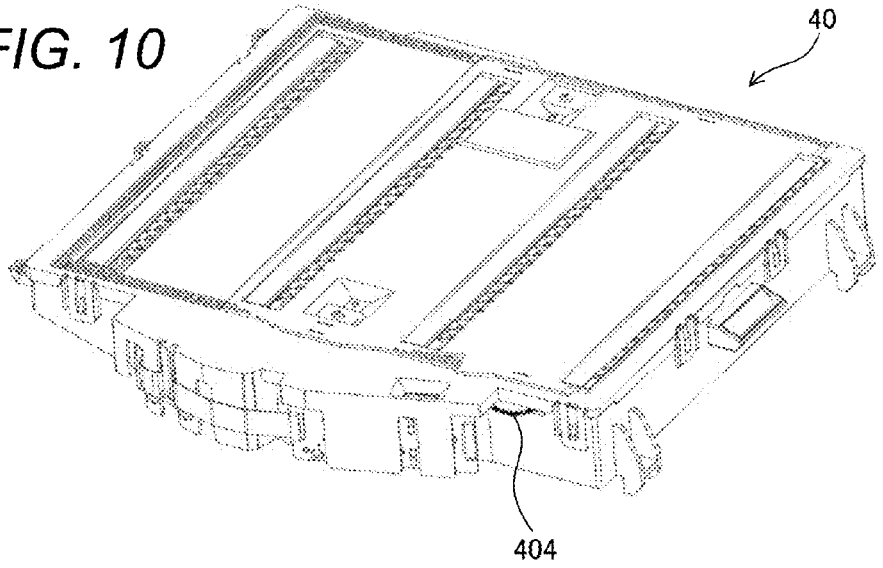
FIG. 10 is a perspective view illustrating the light scanning apparatus in which the cover member is mounted to the optical box according to the second embodiment.

FIG. 9 is a perspective view illustrating the optical box 400 and the cover member 415 according to the second embodiment. FIG. 10 is a perspective view illustrating the light scanning apparatus 40 in which the cover member 415 is mounted to the optical box 400 according to the second embodiment. As is understood from FIG. 9 and FIG. 10, the length of the electric wire bundle 404 exposed to the exterior of the light scanning apparatus 40 is smaller than that in the first embodiment illustrated in FIG. 3 and FIG. 4. Therefore, the electric wire bundle 404 is less liable to be caught in other components of the main body 1 of the image forming apparatus at the time of mounting the light scanning apparatus 40 to the mounting portion 440 of the image forming apparatus 418 while sliding the light scanning apparatus 40. Further, at the time of mounting the light scanning apparatus 40 to the main body 1 of the image forming apparatus, the electric wire bundle 404 is positioned on an upstream side in a sliding direction of the optical box 400, and hence the electric wire bundle 404 is never caught in other components on the far side of the main body 1 of the image forming apparatus 418. Further, when the light scanning apparatus 40 is transported, the electric wire bundle 404 exposed to the exterior is less liable to be caught in other objects.

(Mounting of Light Scanning Apparatus to Image Forming Apparatus)

Figure 11:
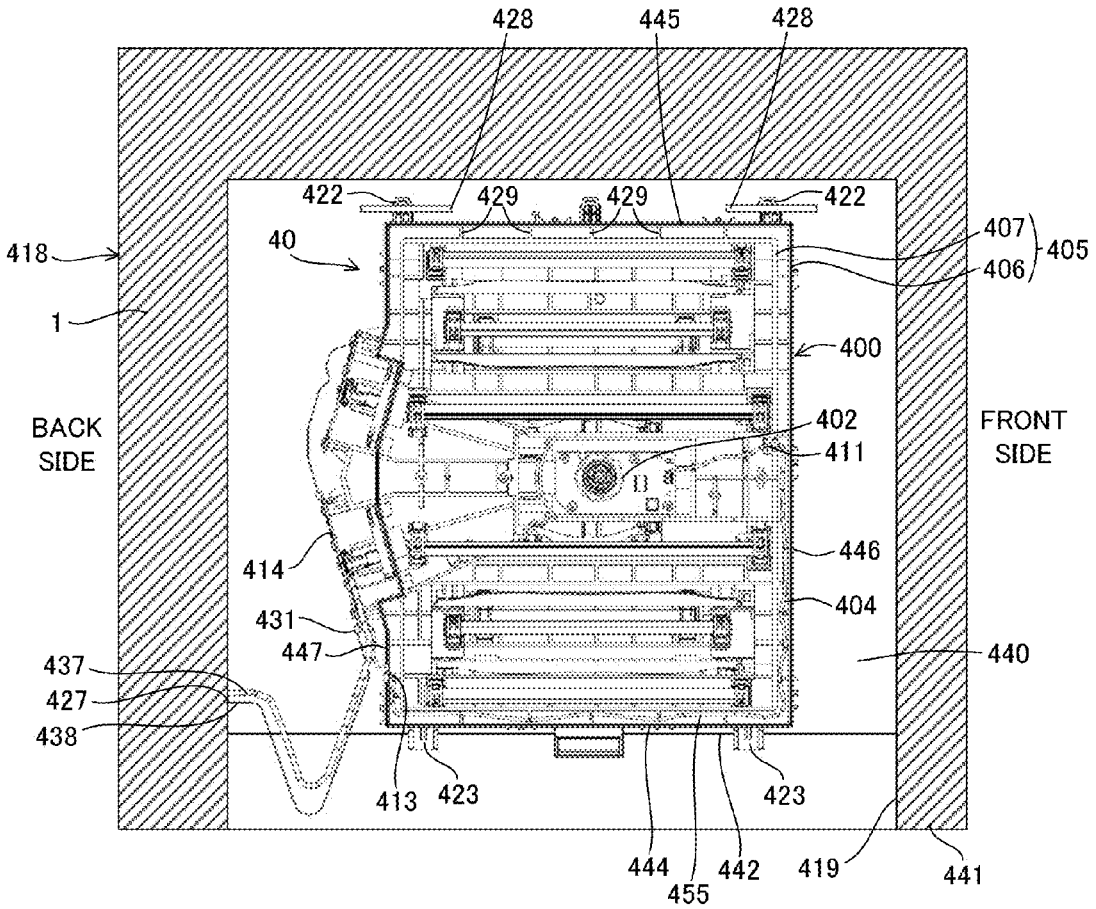
FIG. 11 is a sectional view illustrating an image forming apparatus according to the second embodiment, which is taken along the plane XI of FIG. 6.

FIG. 11 is a sectional view illustrating the image forming apparatus 418 according to the second embodiment, which is taken along the plane XI of FIG. 6. Note that, for the sake of illustration, the cover member 415 is removed from the light scanning apparatus 40 in FIG. 11.

The main body 1 of the image forming apparatus 418 includes electric wire bundles 437 and 438. The electric wire bundles 437 and 438 of the main body 1 are electrically connected to the laser drive circuit board 414 of the light scanning apparatus 40. The electric wire bundle 437 includes a power supply electric wire configured to supply power to each of the light source units 408, and a power supply electric wire configured to supply power to the deflecting device 41. The electric wire bundle 438 includes a communication wire configured to communicate with each of the light source units 408, a drive signal wire configured to transmit a drive signal for driving each of the light source units 408, an image signal wire configured to transmit an image signal to each of the light source units 408, and a signal wire (communication wire) configured to transmit a signal to the deflecting device 41.

The electric wire bundle 404 of the light scanning apparatus 40 is directly connected to the connector 431 provided on the laser drive circuit board 414. When proper electric wires of the respective electric wire bundles 437 and 438 of the main body 1 and a proper electric wire of the electric wire bundle 404 of the light scanning apparatus 40 are connected to each other in an electric circuit of the laser drive circuit board 414, the motor 402 is energized, and the control of the motor 402 is enabled. According to the second embodiment, the electric wire bundle 425 of the main body 1 dedicated to driving the motor 402, which is necessary in the first embodiment, can be omitted. Thus, costs can be further reduced.

According to the first embodiment and the second embodiment, the electric wire bundle 404 arranged in the double wall 405 of the optical box 400 is led out from the outlet 413 provided closer to the opening portion 419, through which the light scanning apparatus 40 is removably mounted, of the image forming apparatus 418 than the inlet 411. Therefore, mounting and dismounting operation for the light scanning apparatus 40 and connector-connecting operation for the electric wire bundle 404 at the time of service operation can be facilitated, and hence high serviceability can be obtained.

According to the embodiment, the electric wire bundle laid in the space formed between the outer wall and the inner wall of the optical box extends from the outlet, arranged closer to the opening portion than the inlet, to the exterior. Therefore, at the time of mounting the light scanning apparatus to the main body of the image forming apparatus through the opening portion, the main body and the light scanning apparatus can be easily electrically connected to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No 2014-015566, filed Jan. 30, 2014, and Japanese Patent Application No 2014-262546, filed Dec. 25, 2014, which are hereby incorporated by reference herein in their entirety.

What is claimed is:

1. A light scanning apparatus to be mounted to a mounting portion of an image forming apparatus through an opening portion of the image forming apparatus including a photosensitive member, the light scanning apparatus comprising:

a light source configured to emit a light beam;

a deflecting device configured to deflect the light beam emitted from the light source so as to scan the photosensitive member with the light beam;

an optical box including an outer wall and an inner wall extending inside the outer wall and along the outer wall so as to face the outer wall, and configured to hold the light source and contain the deflecting device inside the inner wall; and electric wires electrically connected to the deflecting device, wherein the optical box includes a space in which the electric wires are laid being formed between the outer all and the inner wall, wherein the electric wires cross over the inner wall, from a space on an inner side of the inner wall so as to be laid in the space formed between the outer wall and the inner wall, and cross over the outer wall from the space formed between the outer wall and the inner wall so as to lead to a space on an outer side of the optical box, and wherein the electric wires are laid in the optical box so that, in a state in which the light scanning apparatus is mounted to the mounting portion of the image forming apparatus, a portion at which the electric wires cross over the outer wall are provided closer to the opening portion of the image forming apparatus than a portion at which the electric wires cross over the inner wall.

2. The light scanning apparatus according to claim 1, wherein a first recess as the portion at which the electric wires cross over the inner wall is formed in the inner wall, wherein a second recess as the portion at which the electric wires cross over the outer wall is formed in the outer wall, and wherein the first recess is formed in the inner wall and the second opening is formed in the outer wall so that, in the state in which the light scanning apparatus is mounted to the mounting portion of the image forming apparatus, the second recess is positioned closer to the opening portion of the image forming apparatus than the first recess.

3. The light scanning apparatus according to claim 1, wherein, in the state in which the light scanning apparatus is mounted to the mounting portion of the image forming apparatus, the electric wires are laid in the space formed between the outer wall and the inner wall on a side, which is close to the opening portion, of the optical box.

4. The light scanning apparatus according to claim 2, wherein the second recess is formed in the outer wall so that, in the state in which the light scanning apparatus is mounted to the mounting portion of the image forming apparatus, the second recess is arranged so as to face a supply portion of electric wires of a main body of the image forming apparatus.

5. The light scanning apparatus according to claim 2, further comprising a drive circuit board configured to drive the light source, wherein the drive circuit board is mounted to an exterior of the optical box, and wherein the second recess is formed in a side, on which the drive circuit board is arranged, of the optical box.

6. The light scanning apparatus according to claim 5, wherein the electric wires extending from the second recess of the light scanning apparatus to the exterior of the optical box is electrically connected to the drive circuit board.

7. The light scanning apparatus according to claim 2, wherein the first recess is formed in the inner wall on an opposite side to the light source across the deflecting device.

8. The light scanning apparatus according to claim 1, wherein the optical box is provided with a plurality of fixing portions configured to fix the light scanning apparatus to the mounting portion of the image forming apparatus, and wherein a fixing portion, which is located on a side of the opening portion, of the plurality of fixing portions is fixed to the mounting portion by a screw.

9. The light scanning apparatus according to claim 1, wherein the optical box includes an imaging optical member configured to image the light beam deflected by the deflecting device onto the photosensitive member, and wherein the electric wires are laid in the space formed between the inner wall and the outer wall so as to extend around the imaging optical member.

10. An image forming apparatus configured to form an image on a recording medium, the image forming apparatus comprising:

a photosensitive member;

a light scanning apparatus as recited in claim 1, which is configured to scan a surface of the photosensitive member with the light beam so as to form an electrostatic latent image;

a developing device configured to develop the electrostatic latent image into a toner image with toner;

a transfer device configured to transfer the toner image onto the recording medium; and a fixing device configured to fix the toner image, which is transferred onto the recording medium, onto the recording medium.

11. The light scanning apparatus according to claim 1, wherein the inner wall is continuously formed from the portion at which the electric wires cross over the inner wall to the portion at which the electric wires cross over the outer wall, so that the electric wires are guided along the inner wall.

12. An image forming apparatus comprising:

a main body provided with an entrance portion disposed on a side of the main body which is different from a front side and a back side of the main body, and the main body further provided with a mounting portion to place a light scanning apparatus, wherein the entrance portion is configured to pass the light scanning apparatus from the outside of the main body toward the mounting portion;

a first photosensitive member;

a second photosensitive member;

the light scanning apparatus which is configured to scan a surface of the first photosensitive member with a first light beam and configured to scan a surface of the second photosensitive member with a second light beam, the light scanning apparatus comprising:

a first light source configured to emit the first light beam;

a second light source configured to emit the second light beam;

a deflecting device configured to deflect the first light beam and the second light beam so that the first light beam scans the first photosensitive member and the second light beam scans the second photosensitive member, the deflecting device deflecting the first light beam and the second light beam toward opposite sides with the deflecting device being interposed therebetween;

an optical box including an outer wall and an inner wall inside the outer wall and along the outer wall so as to face the outer wall;

electric wires electrically connected to the deflecting device, wherein the optical box includes a space in which the electric wires are laid being formed between the outer wall and the inner wall, wherein the electric wires cross over the inner wall at a first portion from inside of the inner wall to the space, and cross over the outer wall at a second portion from the space to outside of the outer wall, wherein the electric wires are laid in the optical box so that the second portion is located closer to the entrance portion than the first portion, wherein the first light source and the second light source are located closer to the back side of the main body than the deflecting device, and wherein the first portion is located closer to the front side of the main body than the deflecting device.

13. The image forming apparatus according to claim 12, wherein the inner wall includes a front side wall and a rear side wall and an another side wall, wherein the front side wall is provided with the first portion, the rear side wall is provided with the second portion, wherein the another side wall is disposed between the front side wall and the rear side wall, wherein the another side wall is disposed closer to the entrance portion than the deflecting device.

14. The image forming apparatus according to claim 13, wherein the rear side wall and the another side wall and the front side wall are connected continuously.

* * * * *